US005912406A

United States Patent [19]

Black

[11] Patent Number: 5,912,406

[45] Date of Patent: Jun. 15, 1999

[54] METHOD OF CLEANING SOILED FABRICS

[76] Inventor: Robert H. Black, 4858 Mariner Point, Jacksonville, Fla. 32225

[21] Appl. No.: 09/081,814

[22] Filed: May 20, 1998

Related U.S. Application Data

[60] Provisional application No. 60/047,815, May 28, 1997.

[51] Int. Cl.[6] ..... D06L 1/16; C11D 1/72; C11D 1/86; C11D 1/825

[52] U.S. Cl. ..... 8/137; 510/337; 510/340; 510/341; 510/356; 510/360; 510/535; 510/342

[58] Field of Search ..... 8/137; 510/337, 510/340, 341, 356, 360, 535, 342

[56] References Cited

U.S. PATENT DOCUMENTS 4,259,217 3/1981 Murphy ..... 510/345
4,332,692 6/1982 Payne et al. ..... 8/137

FOREIGN PATENT DOCUMENTS 1518676 7/1978 United Kingdom .

*Primary Examiner*—Alan Diamond
*Attorney, Agent, or Firm*—Browdy and Neimark

[57] ABSTRACT

A method of cleaning soiled fabrics, particularly fabrics that are hydrophobic, with an aqueous fabric cleaning composition having a non-ionic surfactant. The method involves alternately adjusting the wash temperature to above and below the cloud point of the non-ionic surfactant to remove oily soils from the fabrics.

3 Claims, No Drawings

METHOD OF CLEANING SOILED FABRICS

CROSS-REFERENCE TO RELATED APPLICATIONS

The present application claims priority under 35 USC §119(e) from U.S. provisional application 60/047,815, filed May 28, 1997, the entire contents of which are hereby incorporated by reference.

BACKGROUND OF THE INVENTION

1. Field of the Invention

This invention relates to a method of cleaning soiled fabric, particularly hydrophobic fabrics with oily hydrophobic soils.

2. Description of the Related Art

Conventionally, the method of washing fabrics in water involves adding a laundry detergent which includes a blend of surfactants, generally anionic surfactants, and additives to the soiled fabrics to be cleaned, followed by agitating to remove soils and oil-containing micelles, and finally by multiple rinsing steps to remove the soils and detergent residues from the cleaned fabrics. However, the conventional method has the drawback that it is quite ineffective in removing oils from hydrophobic fabrics such as polyester and polypropylene.

SUMMARY OF THE INVENTION

It is accordingly an object of the present invention to overcome the deficiencies in the prior art, such as noted above.

The present invention relates to a method of cleaning soiled fabric where an aqueous fabric cleaning composition comprising a non-ionic surfactant is applied to completely wet the soiled fabric at a temperature below the cloud point of the non-ionic surfactant. The soil is removed upon heating and cooling the soiled fabric wetted with the aqueous fabric cleaning composition followed by water rinse.

DETAILED DESCRIPTION OF THE INVENTION

The method of cleaning soiled fabric according to the present invention takes advantage of the reverse solubility behavior of non-ionic surfactants. In contrast to ionic compounds, non-ionic surfactants become less water soluble and more hydrophobic at higher temperatures. Such a reverse solubility behavior is expressed by the cloud point, where the cloud point, which alludes to the observation that the solution becomes turbid, is the temperature where insolubility of the non-ionic surfactant in water is reached. In a standard test method, the cloud point of a surfactant is determined by heating a 1% aqueous solution to form a turbid solution where the non-ionic surfactant is above its solubility level in water, and then, as the solution is slowly cooled, monitoring the transition from a turbid solution to a clear solution.

It was discovered by the present inventor that this reverse solubility behavior of non-ionic surfactants in water can be used to effectively remove oily soils from hydrophobic fabrics where conventional detergent blends are ineffective in removing oils. The present method of cleaning fabric is thus particularly suited to removing oily and hydrophobic soils from fabrics that are hydrophobic and involves applying an aqueous fabric cleaning composition, which includes a non-ionic surfactant having a cloud point between 4 and 90° C., to a soiled fabric. Preferably, the cloud point of the non-ionic surfactant used in the aqueous fabric cleaning composition is in the range of about 25 to 35° C.

An important feature of the present method is that the aqueous fabric cleaning composition must be applied to the soiled fabric at a temperature below the cloud point of the non-ionic surfactant in the composition. The soiled fabric is agitated with the aqueous fabric cleaning composition to obtain complete wetting, followed by adding hot water to the wetted soiled fabric to raise the temperature for washing to above the cloud point of the non-ionic surfactant. By washing the soiled fabric at a temperature above the cloud point, the non-ionic surfactant becomes insoluble in the wash water and selectively dissolves into oils such as the soils of fabric to be cleaned. Cold water is later added to lower the wash temperature below the cloud point of the non-ionic surfactant and agitated to solubilize the non-ionic surfactant dissolved in the soil, and thereby remove the soil from the fabric into the wash water. Subsequent cold water rinse with agitation completely removes residual and loose soils. An anionic and/or cationic surfactant can be optionally added in the wash cycle when the fabric to be cleaned has a high oily soil load or when the residual deposits on the fabric are to be reduced as low as possible.

A preferred embodiment of a fabric cleaning concentrate in percent by weight is as follows:

| | |
|---|---|
| linear alcohol ethoxylate propoxylate | 97.5 |
| polyvinyl pyrrolidone | 2.0 |
| N-octyl-2-pyrrolidone | 0.5 |

where the concentrate is diluted with water to 3% by weight to arrive at the fabric cleaning composition. In this preferred embodiment, the polyvinyl pyrrolidone serves as an agent that prevents dye and soil transfer between different pieces of fabric and the N-octyl-2-pyrrolidone is a super wetting agent for facilitating the wetting or distribution of the non-ionic surfactant over the surface of the fabric.

Besides superwetting agents and agents that prevent dye/soil transfer, there may be other optional additives in the aqueous fabric cleaning composition, including, but not limited to: builders, such as sodium tripolyphosphate and zeolite; chelants, such as EDTA; agents for increasing the pH, such as sodium carbonate; washing machine protectants, such as silicates; fabric brighteners; processing aids, such as sodium sulfate; anti-redeposition agents, such as carboxymethyl cellulose; bleaching agents, such as sodium perborate and sodium hypochlorite; soil releasing polymers; enzymes, such as proteases and lipases; fabric softeners, such as quaternary amines; and solvents, such as glycol ethers and short chain alcohols. These additives as well as others which are well-known in the art of laundry detergents are well within the skill of those in the art.

Any commercially available laundry detergent having an anionic surfactant blend can be optionally added to the wash cycle according to manufacturer's instructions in order to provide addition cleaning. An example of a concentrate containing an anionic surfactant blend, which can be diluted with water to 3% by weight, is as follows:

| | Percent |
|---|---|
| sodium tripolyphosphate | 5% |
| tetrasodium EDTA | 1% |
| sodium carbonate | 10% |

-continued

| | Percent |
|---|---|
| sodium metasilicate | 2% |
| sodium sulfate | 10% |
| carboxymethyl cellulose | 2% |
| sodium N-methyl-N-oleoyltaurate | 70% |

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of cleaning soiled fabric comprising the steps of:

applying an aqueous fabric cleaning composition comprising a non-ionic surfactant having a cloud point in the range of 4 to 90° C. to soiled fabric, wherein the fabric cleaning composition is contacted with the soiled fabric at a temperature below the cloud point of the non-ionic surfactant and the soiled fabric has hydrophobic soils;

agitating to completely wet the soiled fabric with the aqueous fabric cleaning composition;

adding hot water to the wetted soiled fabric to raise the temperature of the wetted soiled fabric above the cloud point of the non-ionic surfactant in the aqueous fabric cleaning composition;

agitating the wetted soiled fabric at a wash temperature above the cloud point of the non-ionic surfactant to dissolve the non-ionic surfactant into the hydrophobic soils of the soiled fabric;

adding cold water to lower the wash temperature below the cloud point of the non-ionic surfactant; and rinsing and agitating with cold water at a temperature below the cloud point of the non-ionic surfactant to remove the hydrophobic soils along with the dissolved non-ionic surfactant and to clean the soiled fabric.

2. The method of cleaning soiled fabric according to claim 1, wherein the aqueous fabric cleaning composition is prepared by diluting a concentrate to about 3% by weight with water, wherein the concentrate comprises:

about 97.5% by weight linear alcohol ethoxylate propoxylate;

about 2% by weight polyvinyl pyrrolidone; and about 0.5% by weight N-octyl-2-pyrrolidone.

3. The method of cleaning soiled fabric according to claim 1, further comprising the step of adding an anionic or cationic surfactant before the rinsing and agitating step.

* * * * *